United States Patent [19]

Demange et al.

[11] 4,354,868

[45] * Oct. 19, 1982

[54] PROCESS FOR THE DESILICONIZATION OF MANGANESE ALLOYS

[75] Inventors: Michel Demange; Louis Septier, both of Le Fayet, France

[73] Assignee: Societe Francaise d'Electrometallurgie-SOFREM, Paris, France

[ * ] Notice: The portion of the term of this patent subsequent to Jun. 23, 1998, has been disclaimed.

[21] Appl. No.: 202,446

[22] PCT Filed: Dec. 6, 1979

[86] PCT No.: PCT/FR79/00123

§ 371 Date: Aug. 11, 1980

§ 102(e) Date: Aug. 11, 1980

[87] PCT Pub. No.: WO80/01170

PCT Pub. Date: Jun. 12, 1980

[30] Foreign Application Priority Data

Dec. 11, 1978 [FR] France ..... 78 35300

[51] Int. Cl.[3] ..... C22B 47/00

[52] U.S. Cl. ..... 75/60; 75/80; 75/129; 75/134 M; 75/135

[58] Field of Search ..... 75/59, 60, 80, 134 M, 75/135, 123 N, 129

[56] References Cited

U.S. PATENT DOCUMENTS

| | | | |
|---|---|---|---|
| 285,786 | 10/1883 | Bennett | 75/59 |
| 3,347,664 | 10/1967 | Bauer, Jr. et al. | 75/133 |
| 3,932,172 | 1/1976 | Knuppel et al. | 75/59 |
| 4,130,417 | 12/1978 | Breuer et al. | 75/60 |
| 4,139,370 | 2/1979 | Breuer et al. | 75/60 |
| 4,274,871 | 6/1981 | Demange et al. | 75/134 M |

FOREIGN PATENT DOCUMENTS

| | | | |
|---|---|---|---|
| 518893 | 11/1955 | Canada | 75/59 |
| 1062591 | 3/1967 | United Kingdom | 75/59 |

*Primary Examiner*—M. J. Andrews

*Attorney, Agent, or Firm*—Dennison, Meserole, Pollack & Scheiner

[57] ABSTRACT

The invention concerns a process of desiliconization of manganese alloys in the liquid state.

By injecting carbon dioxide into the liquid alloy, which injection can be effected by an additional neutral gas, or oxidizing agent, the silicon is oxidized to $SiO_2$. The addition of lime or dolomite favors the slagging of the silicon. By this process the silicon content can be as low as 0.1%.

The process is particularly applicable for obtaining a ferromanganese with low carbon and low silicon content.

13 Claims, No Drawings

PROCESS FOR THE DESILICONIZATION OF MANGANESE ALLOYS

The present invention concerns a process for the desiliconization by means of carbon dioxide of manganese alloys and in particular ferromanganese alloys, in the liquid state.

Manganese alloys which are intended for siderurgical uses are produced by two broad types of process:

When carbon-saturated alloys are to be produced, manganese ore is treated in an electric furnace or in a blast furnace, with one or more carbon-bearing reducing agents.

When the alloys to be produced are not carbon-saturated, a manganese and silicon alloy is reacted on a manganese ore in the presence of lime. These reactions may be carried out in an electric furnace similar to those used in steel marking or in a ladle in which the manganese-silicon alloy is reacted with a molten mixture of lime and manganese ore.

In these two production processes, the resulting product is a ferromanganese which has a greater or lesser silicon content and whose silicon content is in equilibrium with the residual content of manganese oxide slag. In accordance with the mass action law, applied to the reaction:

$$Si+2MnO \rightleftarrows SiO_2+2Mn$$

the losses of manganese in the slag increase in proportion as the silicon content of the final metal falls.

In order to comply with the requirements made by those in the siderurgical industry, attempts have been made to reduce the amount of silicon in manganese-base addition alloys. Many studies have been carried out and published, all of which aimed to reduce the losses in respect of manganese in the slag, for a given silicon content in the commercial alloy. The most effective process consisted of increasing the basicity number of the slag by increasing its proportion of lime. This method suffers from disadvantages since, on the one hand, it contributes to increasing the volume of the slag and on the other hand it increases its melting temperature, that is to say, it results in the operating temperature of the metallurgical apparatus being higher and the losses of manganese due to volatilization being higher.

Another solution to the problem of low silicon content comprises producing alloys which are not carbon-saturated by injecting oxygen into a carbon saturated base alloy which therefore has a low silicon content. This process of decarbonization with pure oxygen, as described in particular in French Pat. Nos. 2,167,520 and 2,317,369 in the name of Gesellschaft für Elektrometallurgie NBH, suffers from the disadvantage of causing severe losses of manganese by volatilization and does not make it possible to achieve very low final carbon proportions, under economically satisfactory conditions.

The present invention concerns a novel process for producing manganese alloys with a very low silicon content, which is applied to all manganese alloys whether carbon-saturated or not.

This process comprises treatment in the liquid state of the manganese alloy which is to be desiliconized by carbon dioxide which reacts on the silicon which is to be removed with sufficiently moderate exothermicity for the degree of volatilization of the manganese to remain very low. Besides the substantial advantage which this process provides by reducing the manganese losses due to volatilization, this process also makes it possible to limit the losses of manganese in the desiliconization scoria as the carbon monoxide produced by the reaction: $Si+2CO_2 \rightarrow SiO_2+2\overset{\uparrow}{CO}$ provides for intense mixing as between the metal and the scoria which accordingly are in almost perfect chemical equilibrium.

According to the stoichiometry, 44.8 liters of $CO_2$ are required to oxidize 28 grams of silicon, that is to say, 1.6 $m^3$ of $CO_2$ per kg of silicon. In practice, we use from 1 to 3 times and preferably from 1 to 2 times the stoichiometric amount of $CO_2$, and 0.5 times and preferably 0.7 times the stoichiometric amount of $CO_2$ when a gas capable of oxidizing silicon is used in combination with the $CO_2$ to make up the balance.

The invention can be carried into effect in any chamber whatever, which we shall refer to hereinafter generally as a "reactor." The walls of the reactor are formed by a refractory cladding, preferably of the magnesium type. The shape of the reactor is not of determining importance, but it is preferable for the reactor shape to have symmetry of revolution. During the desiliconization treatment, the axis of symmetry may be vertical or slightly inclined, and the reactor may be stationary or may rotate about its axis. In order to provide optimum content between the carbon dioxide and the manganese alloy to be desiliconized, it is preferable for the height of liquid alloy in the reactor to be greater than the diameter of the top surface. For the same reason, it is preferable for the carbon dioxide to be introduced at the bottom of the reactor by means of a pipe positioned in the side wall, adjacent the bottom, or disposed in the actual bottom of the reactor, or by any other known equivalent means.

In order to promote the desiliconization reaction: $Si+2CO_2 \rightarrow SiO_2+2\overset{\uparrow}{CO}$ it is possible to add lime (CaO) which is intended to scorify the silica, in proportions such that the final $CaO/SiO_2$ ratio is from 0.8 to 2.5. The lime may be added either in the powder state in suspension in the carbon dioxide, or in the form of pieces, at the surface of the alloy to be treated. The addition of lime may be totally or partially replaced by the addition of calcium carbonate, the thermal decomposition of which, at the temperature of the reaction, provides both the carbon dioxide and the calcium oxide required.

It is possible for the addition of lime to be accompanied by additions of manganese oxide or manganese ore, which are intended to limit the degree of scorification of the manganese contained in the alloy being treated, in a proportion of from 3 to 15% by weight of the treated alloy. When the reaction temperature would rise to such an extent that there would be a fear of losses of manganese due to volatilization, it is also possible to add amounts of ferromanganese in powder or piece form, in order to reduce the temperature, in a proportion of between 0.5 to 10% by weight of the alloy to be treated.

Finally, the addition of lime may be partly or totally replaced in an addition of crude dolomite ($CaCO_3$, $MgCO_3$) or calcined dolomite (CaO, MgO) which makes it possible somewhat to reduce the degree of wear of the refractory materials of the reactor, when they are of magnesium type.

Although desiliconization can be achieved by injecting pure carbon dioxide, it has been found that it was possible for the action of this gas to be strengthened, modulated or completed by associating therewith make-up gases such as pure oxygen, air, nitrogen, argon or steam. By suitably selecting the make-up gas, it is possible to control the temperature, eliminate parasitic gases which are contained in the alloy or achieve secondary chemical or physical-chemical effects. When at least one oxidizing gas other than carbon dioxide is used as the make-up gas, it is possible to reduce the proportion of $CO_2$ which is introduced, below the stoichiometric amount, for example down to 0.5 and preferably 0.7 times stoichiometry. The remainder of the desiliconization action is then produced by the oxidizing make-up gas or gases referred to above. The make-up gases may be used at the same time as the carbon dioxide or sequentially. In the former case, they can be introduced in mixture with the carbon dioxide or by means of a double pipe comprising for example two coaxial members. Thus, when treating manganese alloys with a low carbon content, it is preferable to dilute the carbon dioxide with an inert gas such as argon in order to prevent recarbonization of the alloy.

The following example makes it possible more clearly to demonstrate an embodiment of the invention:

EXAMPLE 1

A tonne of ferromanganese having the composition set out below is to be desiliconized:

Si: 1.0%
C: 0.9%
Mn: 82.7%
Fe: balance

The treatment is carried out in a cylindrical reactor comprising magnesia bricks joined with a carbon-bearing paste, being 0.75 m in diameter and 1.25 m in height. The thickness of the liquid ferromanganese layer in the reactor is about 0.35 m. Injection of the carbon dioxide is effected by means of a blast pipe which is 14.5 mm in diameter and which opens horizontally into the reactor at about 5 cm above the bottom thereof.

The treatment comprises injecting 20 normal cubic meters of carbon dioxide, over a period of 15 minutes. During the first 12 minutes, the $CO_2$ is associated with oxygen, in a proportion of 1 $m^3$ of oxygen for 3 $m^3$ of $CO_2$.

During the last 3 minutes, the $CO_2$ is injected alone, so as to control the temperature of the bath and to limit volatilization of the manganese.

In addition, during the operation, 30 kg of CaO and 60 kg of manganese ore are added.

After treatment, 975 kg of alloy is obtained, containing:

Si: 0.12%
C: 0.95%
Mn: 81.80%
Fe: balance

After cleaning, the scoria is recovered so that it can be used in the production of silico-manganese. The desiliconized ferromanganese is cast in an ingot mold after optionally having been subjected to deoxidization by means of aluminum.

I claim:

1. A process for desiliconization of manganese base alloys containing silicon characterized by injection into said alloy which is liquid and disposed in a reactor, an amount of carbon dioxide which is from about 1 to about 3 times the stoichiometric amount which permits oxidation of silicon in accordance with the reaction: $Si+2CO_2 \rightarrow SiO_2+2CO$, thereby removing silicon and affecting an alloy having a very low silicon content.

2. A process for the desiliconization of manganese base alloys in accordance with claim 1 characterized in that the amount of $CO_2$ injected is from about 0.5 to about 0.7 times the stoichiometric amount.

3. A process for the desiliconization of manganese base alloys in accordance with claim 1 characterized in that a basic substance is introduced into the reactor during the injection of $CO_2$, to scorify the silica formed by oxidation of the silicon.

4. A process for the desiliconization of manganese base alloys in accordance with claim 3 characterized in that the basic substance is calcium oxide in an amount such that the final scoria has a $CaO/SiO_2$ ratio of from about 0.8 to about 2.5.

5. A process for the desiliconization of manganese base alloys in accordance with claim 3 characterized in that the basic substance is at least partly crude or calcined dolomite.

6. A process for the desiliconization of manganese base alloys in accordance with claim 3 characterized in that the basic substance is calcium carbonate whose thermal decomposition in the reactor provides at least a part of the lime and the $CO_2$ required for desiliconization.

7. A process for the desiliconization of manganese base alloys in accordance with claim 3 characterized in that the basic substance introduced in powder form is entrained in the flow of carbon dioxide.

8. A process for the desiliconization of manganese base alloys in accordance with claim 1, claim 2, claim 3, claim 4, claim 5, claim 6 or claim 7, characterized by introducing into the reactor an oxygen-bearing manganese compound in a proportion of from about 3% to about 15% by weight of the alloy to be desiliconized.

9. A process for the desiliconization of manganese base alloys in accordance with claim 8, characterized in that ferromanganese in powder or piece form is introduced into the reactor, in a proportion of from about 0.5% to about 10% by weight of the alloy to be desiliconized.

10. A process for the desiliconization of manganese base alloys in accordance with claim 9, characterized in that the action of the carbon dioxide is completed by at least one make-up gas selected from air, oxygen, nitrogen, argon and steam.

11. A process for the desiliconization of manganese base alloys according to claim 10 characterized in that the make-up gas is introduced simultaneously with the injection of $CO_2$.

12. A process for the desiliconization of manganese base alloys in accordance with claim 10 characterized in that the make-up gas is introduced after the injection of $CO_2$.

13. A process for the desiliconization of manganese base alloys in accordance with claim 1 wherein said manganese base alloy is a ferromanganese alloy.

* * * * *